US008759264B2

(12) United States Patent
Kupfer et al.

(10) Patent No.: US 8,759,264 B2
(45) Date of Patent: Jun. 24, 2014

(54) WATER-BASED HYDRAULIC FLUIDS COMPRISING DITHIO-DI(ARYL CARBOLIC ACIDS)

(75) Inventors: Rainer Kupfer, Hattersheim (DE); Carsten Cohrs, Frankfurt (DE)

(73) Assignee: Clarient Finance (BVI) Limited, Tortola (VG)

( * ) Notice: Subject to any disclaimer, the term of this patent is extended or adjusted under 35 U.S.C. 154(b) by 241 days.

(21) Appl. No.: 13/140,600

(22) PCT Filed: Dec. 2, 2009

(86) PCT No.: PCT/EP2009/008586

§ 371 (c)(1), (2), (4) Date: Jun. 17, 2011

(87) PCT Pub. No.: WO2010/069464

PCT Pub. Date: Jun. 24, 2010

(65) Prior Publication Data

US 2012/0040875 A1 Feb. 16, 2012

(30) Foreign Application Priority Data

Dec. 19, 2008 (DE) ..... 10 2008 064 004

(51) Int. Cl.

| | |
|---|---|
| ***C07C 65/17*** | (2006.01) |
| ***C08K 5/01*** | (2006.01) |
| ***C07C 325/00*** | (2006.01) |
| ***C07C 323/00*** | (2006.01) |
| ***C07C 381/00*** | (2006.01) |

(52) U.S. Cl.
USPC ..... 508/479; 508/516; 568/23

(58) Field of Classification Search
USPC ..... 508/479, 516; 568/23
See application file for complete search history.

(56) References Cited

U.S. PATENT DOCUMENTS

| | | | | |
|---|---|---|---|---|
| 3,801,517 | A | 4/1974 | Richwine | |
| 3,992,312 | A | 11/1976 | Genjida et al. | |
| 4,138,346 | A | 2/1979 | Nassry et al. | |
| 4,209,414 | A | 6/1980 | Holgado et al. | |
| 4,402,907 | A | 9/1983 | Clark | |
| 4,434,066 | A | 2/1984 | Lewis | |
| 4,452,710 | A | 6/1984 | Williams | |
| 4,493,802 | A | 1/1985 | Jaedicke et al. | |
| 4,911,888 | A | 3/1990 | Fikentscher et al. | |
| 5,324,440 | A * | 6/1994 | Delfort et al. | 508/398 |
| 5,468,399 | A | 11/1995 | Delfort et al. | |
| 2005/0020457 | A1 * | 1/2005 | Rohrbach et al. | 508/478 |

FOREIGN PATENT DOCUMENTS

| | | |
|---|---|---|
| DE | 2 534 808 | 3/1976 |
| DE | 2 752 218 | 6/1978 |
| DE | 2 909 699 | 9/1979 |
| DE | 3 719 046 | 12/1988 |
| EP | 0 046 139 | 2/1982 |
| EP | 0 059 461 | 9/1982 |
| EP | 0 085 181 | 8/1983 |
| JP | S5119280 | 2/1976 |
| JP | S5682892 | 7/1981 |
| JP | H0617076 | 1/1994 |
| JP | 2002-086613 | 3/2002 |
| JP | 2006-083378 | 3/2006 |
| WO | WO96/34076 | 10/1996 |

OTHER PUBLICATIONS

International Search Report for PCT/EP2009/0008586, dated Feb. 19, 2010.
Translation of the International Preliminary Report on Patentability for PCT/EP2009/008586, dated Feb. 19, 2010.
T. Mang, W. Dressel: "Lubricants and Lubrications", Wiley-VCH, Weinheim, 2001, chapter 11.4.6, pp. 265-267.
T. Mang, W. Dressel: "Lubricants and Lubrications", Wiley-VCH, Weinheim, 2001, chapter 14.3, pp. 363-369.
Lubrications Engineering, Jun. 1977, vol. 33, pp. 291-298.
Chemical Abstract Search Report, Mar 25, 2013, pp. 1-34.
English abstract for JPS5682892, Jul. 6, 1981.
English abstract for JP 2002-086613, Mar. 26, 2002.
English abstract for JP 2006-083378, Mar. 30, 2006.

* cited by examiner

*Primary Examiner* — James Goloboy
*Assistant Examiner* — Francis C Campanell
(74) *Attorney, Agent, or Firm* — Tod A. Waldrop

(57) ABSTRACT

The invention relates to water-based hydraulic fluids comprising a) water, b) at least one glycol, a polyglycol, or both, and c) 0.1 to 30 wt % of at least one compound of formula 1, (1)

where M is hydrogen, an alkali metal, an alkali earth metal, or ammonia, $Ar^1$ and $Ar^2$ are independently monocyclic or polycyclic aromatic groups that can have substituents or can comprise heteroatoms.

21 Claims, No Drawings

WATER-BASED HYDRAULIC FLUIDS COMPRISING DITHIO-DI(ARYL CARBOLIC ACIDS)

The present invention relates to water-based hydraulic fluids which comprise dithiodi(arylcarboxylic acids) and which have improved performance properties, and to the use of dithiodi(arylcarboxylic acids) as an anticorrosive or lubricity additive in hydraulic fluids.

Water-based hydraulic fluids are used in a multitude of applications, particularly when hydraulic fluids which comprise mineral oil and emerge from the hydraulic system give rise to fire hazards or hazards for the environment. Typical fields of use are steelworks, forges, coal mining and oil extraction systems, and also wind farms.

Owing to reduced lubricity and increased corrosion risk compared to fluids comprising mineral oil, carefully balanced additive packages are additionally used. A water-based hydraulic fluid typically comprises the following components (described, for example, in DE-A-2 534 808 and T. Mang, W. Dressel: "Lubricants and Lubrications", Wiley-VCH, Weinheim, 2001, chapter 11.4.6):

| | |
|---|---|
| (1) water | 35-70% |
| (2) thickeners or freezing point depressants (e.g. glycols) | 25-50% |
| (3) lubricants | 0-20% |
| (4) anticorrosives | 0-10% |
| (5) pH adjusters (e.g. alkanolamines) | 0-10% |
| (6) defoamers | 0-2% |
| (7) antioxidants | 0-2% |
| (8) dye | 0-0.1% |

The pH is typically within the alkaline range, generally pH>9. The increase in the pH contributes to corrosion protection. Of crucial significance in the above composition are the anticorrosives and lubricants.

EP-A-0 059 461 discloses, as a lubricant, polyalkylene glycols which may also serve as anticorrosives, and the use of dithiophosphonates as lubricants.

DE-A-2 534 808 describes oxyalkylated polyamides formed from dicarboxylic acids and oligoamines, which have improved lubrication properties, and the use thereof in water-based hydraulic fluids.

U.S. Pat. No. 4,143,4066 discloses hydroxy- or nitro-substituted aromatic carboxylic acids as lubricants in aqueous hydraulic fluids.

U.S. Pat. No. 4,138,346 discloses phosphoric mono- and diesters and sulfur compounds such as mercaptobenzothiazoles, dithiobis(thiazoles) and alkyl disulfides as lubricants in aqueous hydraulic fluids.

WO-9634076 discloses, as anticorrosives in aqueous hydraulic fluids, aliphatic carboxylic acids and alkali metal or ammonium salts thereof.

EP-A-0 059 461 discloses carboxylic diethanolamides, amines and substituted imidazolines, fatty acid ethoxylates as anticorrosives in aqueous hydraulic fluids.

U.S. Pat. No. 4,452,710 discloses, as an anticorrosive in aqueous hydraulic fluids, carboxamides with an additional free carboxylic acid function.

The specified requirements of good lubrication and anticorrosive action are accompanied by further requirements in aqueous hydraulic fluids currently being used.

The introduction of salts during the use of the fluid or the use of hard water or even seawater to formulate the fluid, which is necessary for economic reasons, requires hard water and electrolyte compatibility of the additives. Many of the currently known additives do not meet one or more of these conditions. For instance, many carboxylic acids and in particular phosphoric esters are not stable to water hardness.

In addition, for economic and ecological reasons, defoamers are frequently dispensed with, which restricts the selection to nonfoaming additives. Ethoxylates and other alkoxylates, aliphatic carboxylic acids, especially fatty acids, and aliphatic carboxylic alkanolamides are known for their high foaming action owing to their surfactant structure.

Additives must not least have good ecotoxicological properties, particularly when the hydraulic fluids are used in ecologically sensitive regions such as the North Sea or the Arctic Ocean. For instance, each additive of a hydraulic fluid must meet the OSPAR criteria for use in oil extraction in the North Sea, which require good biodegradability and low toxicity. Many additives do not meet these criteria. For instance, imidazolines and mercaptobenzothiazoles are not permitted owing to their toxicity toward marine organisms, and so additives with poorer performance properties are frequently used. Likewise for the purposes of ecological safety and also due to economic considerations, a minimum use concentration of the additives is desirable. This often becomes difficult since additives which achieve a particular effect, for example lubrication, often exert an adverse influence on other properties, for example corrosion protection. For instance, it is known that ethoxylates, in particular when they are highly ethoxylated, exhibit good lubricity but are detrimental to corrosion protection (see T. Mang, W. Dressel: "Lubricants and Lubrications", Wiley-VCH, Weinheim, 2001, chapter 14.3). A significant improvement is therefore constituted by components which are polyfunctional or else have synergistic effects with other additives.

It was thus an object of the present invention to find improved, low-foam, hard water-stable anticorrosives and lubricant additives for water-based hydraulic fluids with good ecotoxicological properties, which require only a low use concentration.

The literature (Lubrication Engineering 1977, Vol. 33, page 291) states that alkali metal salts of dithiodibenzoic acid in aqueous metal cutting fluids have only a poor lubricity compared to aliphatic sulfur-containing acids. It has now been found that dithiodi(arylcarboxylic acids) of the formula 1 have very good corrosion protection properties, especially at high pH. It has additionally been found that the dithiodi (arylcarboxylic acids) also possess good lubricant properties which are sufficient for use in hydraulic fluids. Moreover, they do not foam, are stable toward hard water and electrolytes and have a low toxicity toward water organisms.

As a further, particularly positive property, it has been found that, in combination with water-soluble anticorrosives, it is possible to achieve a further improvement in corrosion protection compared to the sole use of these water-soluble anticorrosives. The synergistic effect of the dithiodi(arylcarboxylic acids) with common water-soluble anticorrosives allows the use concentration of the additive package in the hydraulic fluid to be reduced. The dithiodi(arylcarboxylic acids) are compatible with the common additives disclosed in the abovementioned prior art. The use of synergistic mixtures of anticorrosives and dithiodi(arylcarboxylic acids) makes it possible to produce hydraulic fluids for the known fields of use, but particularly for offshore applications in ecologically sensitive regions such as the North Sea, which are ecologically and economically superior to the systems known to date which are permitted there.

The invention therefore provides water-based hydraulic fluids comprising a) water, b) at least one glycol, a polyglycol or both, and c) from 0.1 to 30% by weight of at least one compound of the formula 1

(1)

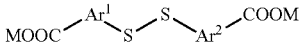

in which

M is hydrogen, alkali metal, alkaline earth metal or ammonium, $Ar^1$ and $Ar^2$ are each independently mono- or polycyclic aromatic groups which may bear substituents or may contain heteroatoms.

The invention further provides for the use of the compounds of the formula (1) in amounts of from 0.1 to 30% by weight as an anticorrosive or lubricity improver in water-based hydraulic fluids.

The invention further provides a process for improving the anticorrosion and lubrication properties of water-based hydraulic fluids, by adding from 0.1 to 30% by weight of a compound of the formula (1) to a hydraulic fluid.

The substituents M are hydrogen in the case of the free acid, and alkali metal ions, alkaline earth metal ions or ammonium ions in the case of salts. In the case of the ammonium ions, the compounds are preferably those which have originated by protonation from the amines described as neutralizing agents in the text which follows. The aryl radicals $Ar^1$ and $Ar^2$ may be the same or different. For preparation reasons, however, preference is given to compounds in which both aromatics are substituted identically. $Ar^1$ and $Ar^2$ are preferably monocyclic or bicyclic aromatic groups, especially monocyclic aromatic groups. $Ar^1$ and $Ar^2$ are preferably each monocyclic benzoic acid derivatives of the formulae 2a-2c. $Ar^1$ and $Ar^2$ may contain heteroatoms.

In the formulae which follow, the two free valences denote the bonding sites to the sulfide bridge and to the COOM group.

(2a)

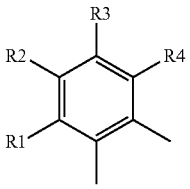

(2b)

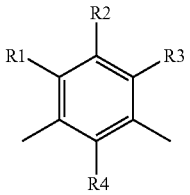

-continued (2c)

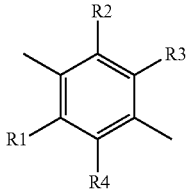

The substituents $R^1$-$R^4$ in the $Ar^1$ and $Ar^2$ radicals are preferably each independently hydrogen, linear, branched and/or cyclic $C_1$-$C_{20}$-alkyl and/or $C_2$- to $C_{20}$-alkenyl radicals, halogen atoms, nitro groups, amino groups, alkoxy groups, hydroxyl or hydroxy-$C_1$-$C_{20}$-alkyl groups. The alkyl or alkenyl radicals are preferably short-chain radicals having from 1 to 6 carbon atoms which do not impair water solubility to too great an extent, for example methyl, ethyl, propyl, isopropyl, butyl, isobutyl and tert-butyl radicals. Preference is further given in accordance with the invention to compounds which bear only one further substituent on the aromatic ring, i.e. in which three of the $R^1$-$R^4$ radicals are hydrogen. More preferably, the radical which is not hydrogen, is then in the meta or para position to the sulfide bridge. In a preferred embodiment, $Ar^1$ and $Ar^2$ have the substitution pattern of (2a) and (2c), particular preference being given to the substitution pattern of the formula (2a).

In a particularly preferred embodiment of the invention, each of the $Ar^1$ and $Ar^2$ radicals represents a monocyclic aromatic radical of the formula (3)

(3)

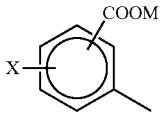

in which the free valence indicates the position of the sulfide bridge, and X is a $C_1$- to $C_4$-alkyl group, a nitro group or a halogen atom. In this embodiment, the compound of the formula (1) corresponds to the formula (4)

(4)

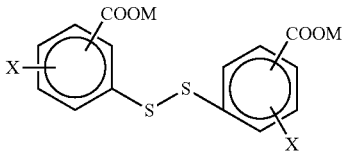

It is additionally preferred that the compound of the formula (1) corresponds to the formula (5)

(5)

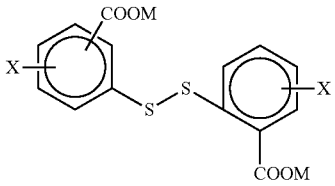

in which X is as defined above.

More preferably, X is in the para position to the sulfide bridge.

More preferably, X is a methyl or ethyl group.

In a further particularly preferred embodiment, the formula (1) represents dithiodibenzoic acid, i.e. $R^1$, $R^2$, $R^3$ and $R^4$ are each H.

The preparation of the compounds of the formula (1) is known from the prior art and is described by way of example in EP-A-0 085 181.

The invention further provides water-based hydraulic fluids which comprise a further anticorrosive in combination with dithiodi(arylcarboxylic acids).

In a preferred embodiment, the hydraulic fluids comprise at least one further anticorrosive in addition to the dithiodi(arylcarboxylic acids). Suitable anticorrosives are benzenesulfonamidocaproic acid, toluenesulfonamidocaproic acid, N-methylbenzenesulfonamidocaproic acid, N-methyltoluenesulfonamidocaproic acid (all formula (6)), alkanoylamidocarboxylic acids, particularly isononanoylamidocaproic acid (formula (7)) and triazine-2,4,6-tris(aminohexanoic acid) (formula (8)), and the alkali metal, alkaline earth metal and amine salts of the compounds of the formulae (6)-(8).

a) toluene- or benzenesulfonamidocaproic acids (formula (6))

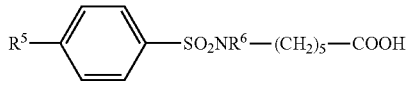

(6)

where $R^5$, $R^6$=H or $CH_3$, b) isononanoylamidocaproic acid (formula (7))

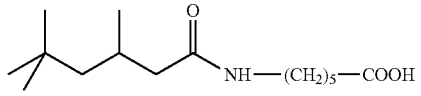

(7)

c) triazinetrisaminohexanoic acid (formula (8))

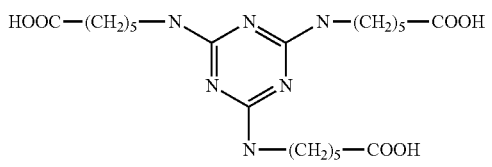

(8)

Further known and suitable anticorrosives are linear or branched $C_6$- to $C_8$-carboxylic acids, for example octanoic acid, 2-ethylhexanoic acid, n-nonanoic acid, n-decanoic acid, n-isodecanoic acid, dicarboxylic acids such as succinic acid, adipic acid, maleic acid, citric acid, and longer-chain dicarboxylic acids such as decanedioic acid, undecanedioic acid or dodecanedioic acid, where the chains may be branched or else cyclic, and polycarboxylic acids. Suitable anticorrosives are also alkanesulfonamides, alkanesulfonamidocarboxylic acids and phthalic monoamides. In addition, it is also possible to use the salts of the compounds listed above.

When the salts of one of the abovementioned anticorrosives are used, they are preferably salts which arise through reaction of the free acids with a neutralizing agent present in the hydraulic fluid.

The hydraulic fluids contain preferably 1-15%, especially 1-10%, of the dithiodi(arylcarboxylic acid) of the formula (1).

When further anticorrosives are used, the total amount of dithiodi(arylcarboxylic acid) and further anticorrosive is generally 0.1-30%, preferably 1-10%, especially 1-5% anticorrosive. The use concentration of the dithiodi(arylcarboxylic acids) is then between 0.05-20%, preferably 0.5-5%, especially 0.5-3%.

When the salts of the anticorrosives are used, the concentrations of the anticorrosives used, reported as percentages by weight, are higher owing to the higher molecular weight of the salts compared to the free acids.

According to the invention, the hydraulic fluid may comprise a lubricant to reduce friction and abrasion. Suitable lubricants in this context are amine, alkali metal or alkaline earth metal salts of alkyl- or arylphosphoric esters and/or amine, alkali metal or alkaline earth metal salts of the phosphoric esters of alkoxylated alcohols. It is equally possible to use polyalkylene glycols. These can be obtained by anionic or metal-catalyzed polymerization of alkylene oxides of the formula (9) with mono-, di-, tri-, tetra- and polyfunctional alcohols or amines or mixtures thereof

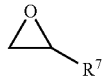

(9)

where $R^7$=hydrogen, methyl, ethyl.

When a plurality of alkylene oxides are used, the polymerization can be effected sequentially (blockwise arrangement of the monomers) or with a mixture of the oxides (random arrangement of the monomers). Suitable starter alcohols for these polyalkylene glycols are, for example, ethylene glycol, propylene glycol, trimethylolpropane, glycerol, pentaerythritol, sorbitol and further polyhydric alcohols. Suitable amines are, for example, the compounds specified hereinafter as neutralizing agents, provided that they contain acidic N—H bonds. The molecular weights of the polyalkylene glycols thus obtained may vary from 500 g/mol to 50 000 g/mol; the molecular weights are typically from 2000 to 10 000 g/mol.

Further suitable lubricants are sulfur compounds such as mercaptobenzothiazoles, dithiobis(thiazoles) and alkyl disulfides, thiophosphonates or inorganic compounds such as phosphoric acid or metal sulfides. In the preferred embodiment of the invention, the hydraulic fluid does not comprise any lubricant, since the lubricity of the anticorrosives, specifically of the dithiodi(arylcarboxylic acids), is already sufficient.

The inventive hydraulic fluids are adjusted with a neutralizing agent to a pH of 8-12, more preferably 9-10. Suitable neutralizing agents are amines of the formula (10)

$$NR^8R^9R^{10} \quad (10)$$

in which $R^8$, $R^9$ and $R^{10}$ are each independently hydrogen or a hydrocarbon radical having from 1 to 100 carbon atoms.

In a first preferred embodiment, $R^8$ and/or $R^9$ and/or $R^{10}$ are each independently an aliphatic radical. This has preferably from 1 to 24, more preferably from 2 to 18 and especially from 3 to 6 carbon atoms. The aliphatic radical may be linear, branched or cyclic. It may additionally be saturated or unsaturated. The aliphatic radical is preferably saturated. The aliphatic radical may bear substituents, for example hydroxyl, $C_1$-$C_5$-alkoxy, cyano, nitrite, nitro and/or $C_5$-$C_{20}$-aryl groups, for example phenyl radicals. The $C_5$-$C_{20}$-aryl radicals may themselves optionally be substituted by halogen atoms, halogenated alkyl radicals, $C_1$-$C_{20}$-alkyl, $C_2$-$C_{20}$-alkenyl, hydroxyl, $C_1$-$C_5$-alkoxy, for example methoxy, amide, cyano, nitrile and/or nitro groups. In a particularly preferred embodiment, $R^8$ and/or $R^9$ and/or $R^{10}$ are each independently hydrogen, a $C_1$-$C_6$-alkyl, $C_2$-$C_6$-alkenyl or $C_3$-$C_6$-cycloalkyl radical and especially an alkyl radical having 1, 2 or 3 carbon atoms. These radicals may bear up to three substituents. Particularly preferred aliphatic $R^8$ and/or $R^9$ and/or $R^{10}$ radicals are hydrogen, methyl, ethyl, hydroxyethyl, n-propyl, isopropyl, hydroxypropyl, n-butyl, isobutyl and tert-butyl, hydroxybutyl, n-hexyl, cyclohexyl, n-octyl, n-decyl, n-dodecyl, tridecyl, isotridecyl, tetradecyl, hexadecyl, octadecyl and methylphenyl.

In a further preferred embodiment, $R^8$ and $R^9$ together with the nitrogen atom to which they are bonded form a ring. This ring has preferably 4 or more than 4, for example 4, 5, 6 or more, ring members. Preferred further ring members are carbon, nitrogen, oxygen and sulfur atoms. The rings may themselves in turn bear substituents, for example alkyl radicals. Suitable ring structures are, for example, morpholinyl, pyrrolidinyl, piperidinyl, imidazolyl and azepanyl radicals. In a preferred embodiment, $R^{10}$ is then H or an alkyl radical having from 1 to 12 carbon atoms.

In a further preferred embodiment, $R^8$, $R^9$ and/or $R^{10}$ are each independently an optionally substituted $C_6$-$C_{12}$-aryl group or an optionally substituted heteroaromatic group having from 5 to 12 ring members.

In a further preferred embodiment, $R^8$, $R^9$ and/or $R^{10}$ are each independently an alkyl radical interrupted by heteroatoms. Particularly preferred heteroatoms are oxygen and nitrogen.

For instance, $R^8$, $R^9$ and/or $R^{10}$ are each independently preferably radicals of the formula (11)

$$—(R^{11}—O)_n—R^{12} \quad (11)$$

in which $R^{11}$ is an alkylene group having from 2 to 6 carbon atoms and preferably having from 2 to 4 carbon atoms, for example ethylene, propylene, butylene or mixtures thereof, $R^{12}$ is hydrogen, a hydrocarbon radical having from 1 to 24 carbon atoms or a group of the formula $—NR^{13}R^{14}$, n is an integer from 2 to 50, preferably from 3 to 25 and especially from 4 to 10 and $R^{13}$, $R^{14}$ are each independently hydrogen, an aliphatic radical having from 1 to 24 carbon atoms and preferably from 2 to 18 carbon atoms, an aryl group or heteroaryl group having from 5 to 12 ring members, a poly(oxyalkylene) group having from 1 to 50 poly(oxyalkylene) units, where the polyoxyalkylene units derive from alkylene oxide units having from 2 to 6 carbon atoms, or $R^{13}$ and $R^{14}$ together with the nitrogen atom to which they are bonded form a ring having 4, 5, 6 or more ring members.

Additionally preferably, $R^8$, $R^9$ and/or $R^{10}$ are each independently radicals of the formula (12)

$$—[R^{15}—N(R^{16})]_m—(R^{16}) \quad (12)$$

in which $R^{15}$ is an alkylene group having from 2 to 6 carbon atoms and preferably having from 2 to 4 carbon atoms, for example ethylene, propylene or mixtures thereof, each $R^{16}$ is independently hydrogen, an alkyl or hydroxyalkyl radical having up to 24 carbon atoms, for example from 2 to 20 carbon atoms, a polyoxyalkylene radical $—(R^{11}—O)_p—R^{12}$, or a polyiminoalkylene radical $—[R^{15}—N(R^{16})]_q—(R^{16})$, where $R^{11}$, $R^{12}$, $R^{15}$ and $R^{16}$ are each as defined above and q and p are each independently from 1 to 50 and m is an integer from 1 to 20 and preferably from 2 to 10, for example three, four, five or six.

The radicals of the formula (12) contain preferably from 1 to 50 and especially from 2 to 20 nitrogen atoms.

Particularly preferred neutralizing agents are water-soluble alkylamines such as methylamine, dimethylamine, trimethylamine, ethylamine, diethylamine, triethylamine, propylamine and longer-chain mono-, di- and trialkylamines, provided that they are water-soluble to an extent of at least 1% by weight, preferably 1-5% by weight. The alkyl chains here may be branched. Equally suitable are oligoamines such as ethylenediamine, diethylenetriamine, triethylenetetramine, tetraethylenepentamine, the higher homologs thereof and mixtures thereof. Further suitable amines in this series are the alkylated, particularly methylated, representatives of these oligoamines, such as N,N-dimethyldiethylenamine, N,N-dimethylpropylamine and longer-chain and/or more highly alkylated amines of the same structure principle. Particularly suitable in accordance with the invention are alkanolamines such as monoethanolamine, diethanolamine, triethanolamine, diglycolamine, triglycolamine and higher homologs, methyldiethanolamine, ethyldiethanolamine, propyldiethanolamine, butyldiethanolamine and longer-chain alkyldiethanolamines, where the alkyl radical may be cyclic and/or branched. Further suitable alkanolamines are dialkylethanolamines such as dimethylethanolamine, diethylethanolamine, dipropylethanolamine, dibutylethanolamine and longer-chain dialkylethanolamines, where the alkyl radical may also be branched or cyclic. In addition, it is also possible in the context of the invention to use aminopropanol, aminobutanol, aminopentanol and higher homologs, and the corresponding mono- and dimethylpropanolamines and longer-chain mono- and dialkylaminoalcohols. Suitable amines are not least specialty amines such as 2-amino-2-methylpropanol (AMP), 2-aminopropanediol, 2-amino-2-ethylpropanediol, 2-aminobutanediol and other 2-aminoalkanols, aminoalkylamine alcohols, tris(hydroxylmethyl)aminomethane, and also end-capped representatives such as methylglycolamine, methyldiglycolamine and higher homologs, di(methylglycol)amine, di(methyldiglycol)amine and higher homologs thereof, and the corresponding triamines and polyalkyene glycol amines (e.g. Jeffamine®). Typically, and in the context of the invention, mixtures of the abovementioned amines are used in order to establish desired pH values.

Further suitable neutralizing agents are the oxides and hydroxides of the alkali metals and/or alkaline earth metals, for example lithium hydroxide, sodium hydroxide, potassium hydroxide, calcium hydroxide and calcium oxide.

The neutralizing agents mentioned are used in amounts which are required to establish a desired pH of the hydraulic fluid. This desired pH is 7-11, preferably 8-10, more preferably 9-10. The amounts of neutralizing agent required for this purpose are generally between 0.1-10%.

According to the invention, the hydraulic fluids may comprise, in addition to water, a freezing point depressant or viscosity regulator. Suitable freezing point depressants are polyols which comprise preferably from 2 to 10 OH groups. Examples thereof are ethylene glycol, diethylene glycol, triethylene glycol and higher polyethylene glycols, propylene glycol, dipropylene glycol and higher polypropylene glycols, the corresponding methylglycols, ethyl-, butyl- and further alkylglycols and alkylpropylene glycols. It is equally possible to use glycerol, diglycerol, triglycerol and higher homologs, 1,3-propanediol and the oligomers and polymers thereof. It is also possible to use mixtures of the compounds mentioned.

Their use concentration is guided by the freezing point required, which may vary significantly according to the application and field of use. 1-50% of freezing point depressant is used, preferably 20-50%, more preferably 30-40%.

Suitable viscosity regulators are polyacrylates, polymethacrylates and polyalkylene glycols, especially high molecular weight polyalkylene glycols. These can be obtained by anionic or metal-catalyzed polymerization of alkylene oxides of the formula (9) or mixtures thereof with mono-, di-, tri-, tetra- and polyfunctional alcohols or amines

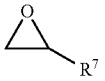

(9)

where $R^7$=hydrogen, methyl, ethyl.

When a plurality of alkylene oxides are used, the polymerization can be effected sequentially (blockwise arrangement of the monomers) or with a mixture of the oxides (random arrangement of the monomers). Suitable starter alcohols for these polyalkylene glycols are, for example, ethylene glycol, propylene glycol, trimethylolpropane, glycerol, pentaerythritol, sorbitol and further polyhydric alcohols. Suitable amines are, for example, the compounds referred to hereinafter as neutralizing agents, provided that they contain acidic N—H bonds. These polyalkylene glycols are typically not selected according to their molecular weight, but rather according to their viscosity at 40° C. or 50° C., which may typically be from a few mPas up to 50 000 mPas and more and is guided by the application. The use concentration of the viscosity regulators is guided by the desired viscosity and may be 1-50%, preferably 20-50%, more preferably 30-40%.

According to the invention, the defoamer, dye and antioxidant additives specified in the prior art can be used in the hydraulic fluid. In the preferred embodiment, however, they can be dispensed with for the reasons stated.

The inventive hydraulic fluids can be prepared by mixing at room temperature or elevated temperatures directly from the components, or by diluting an additive package prepared beforehand with water, or else by diluting an additive package prepared beforehand with a mixture of water and the freezing point depressant. When the hydraulic fluid is prepared directly from the components, it is advisable to initially charge the water and if appropriate the freezing point depressant and then to add the further constituents, preference being given to first adding the neutralizing agent, then the compound of the formula (1), then—if necessary—the further lubricants and the additional anticorrosives. Further additives such as defoamers, dyes, antioxidants and viscosity regulators are added last. When the additive package is prepared separately, water and the freezing point depressant, provided that it is part of the additive package, are initially charged, then the neutralizing agent is added and then the further components in the above sequence. In the case of high viscosities, especially when the freezing point depressant is not part of the additive package, a higher temperature than room temperature may be necessary in the course of mixing, but this temperature generally does not exceed 80-100° C. In the case of particularly high viscosities, the additive package can be diluted with water.

All percentages in this application are percentages by weight based on the total weight of the hydraulic fluid. Exceptions are indicated.

EXAMPLES

Dithiodiarylcarboxylic acids of the formula (2a) are referred to hereinafter as o (ortho), those of the formula (2b) as m (meta) and those of the formula (2c) as p (para). The concentrations used were selected such that the hydraulic fluids achieved the desired corrosion protection (no corrosion at use concentration 15%).

Example 1 (Prior Art)

Hydraulic Fluid A Consisting of

| | |
|---|---|
| water | 43% |
| monoethylene glycol | 40% |
| monoethanolamine | 5% |
| triethanolamine | 3% |
| mixture of mono- and dibutyl phosphate | 7% |
| isononanoylamidocaproic acid | 2% |

Example 2 (Prior Art)

Hydraulic Fluid B Consisting of

| | |
|---|---|
| water | 43% |
| monoethylene glycol | 40% |
| monoethanolamine | 2% |
| triethanolamine | 5% |
| EO-PO block polymer, $M_w$ 600 (polyalkylene glycol) | 5% |
| Isononanoylamidocaproic acid | 5% |

Example 3

Hydraulic Fluid C Consisting of

| | |
|---|---|
| water | 46% |
| monoethylene glycol | 40% |
| triethanolamine | 4% |
| monoethanolamine | 3% |
| o-dithiodibenzoic acid | 7% |

Example 4

Hydraulic Fluid D Consisting of

| | |
|---|---|
| water | 44% |
| monoethylene glycol | 40% |
| triethanolamine | 4% |
| monoethanolamine | 4% |
| m-dithiodibenzoic acid | 9% |

Example 5

Hydraulic Fluid E Consisting of

| | |
|---|---|
| water | 42% |
| monoethylene glycol | 40% |
| triethanolamine | 4% |
| monoethanolamine | 5% |
| p-dithiodibenzoic acid | 8% |

Example 6

Hydraulic Fluid F Consisting of

| | |
|---|---|
| water | 46% |
| monoethylene glycol | 40% |
| triethanolamine | 4% |
| monoethanolamine | 3% |
| o-dithiodi(4-chlorobenzoic acid) | 7% |

Example 7

Hydraulic Fluid G Consisting of

| | |
|---|---|
| water | 46% |
| monoethylene glycol | 40% |
| triethanolamine | 4% |
| monoethanolamine | 3% |
| o-dithiodi(4-methylbenzoic acid) | 7% |

Example 8

Hydraulic Fluid H Consisting of

| | |
|---|---|
| water | 46% |
| monoethylene glycol | 40% |
| triethanolamine | 4% |
| monoethanolamine | 3% |
| o-dithiodi(4-nitrobenzoic acid) | 7% |

Example 9

Hydraulic Fluid I Consisting of

| | |
|---|---|
| water | 45% |
| monoethylene glycol | 40% |
| triethanolamine | 4% |
| monoethanolamine | 3% |
| o-dithiodi(2,5-dimethylbenzoic acid) | 8% |

Example 10

Hydraulic Fluid J Consisting of

| | |
|---|---|
| water | 45% |
| monoethylene glycol | 40% |
| triethanolamine | 4% |
| monoethanolamine | 3% |
| 1,1'-dithiodi(naphthalene-2-carboxylic acid) | 9% |

Example 11

Hydraulic Fluid K Consisting of

| | |
|---|---|
| water | 46% |
| monoethylene glycol | 40% |
| triethanolamine | 3% |
| monoethanolamine | 3% |
| 5,5'-dithiodi(quinoline-6-carboxylic acid) | 9% |

Example 12

Hydraulic Fluid L Consisting of

| | |
|---|---|
| water | 49% |
| monoethylene glycol | 40% |
| triethanolamine | 5% |
| monoethanolamine | 2% |
| o-dithiodibenzoic acid | 2% |
| isononanoylamidocaproic acid | 2% |

TABLE 1

Performance properties of fluids A-L

The table demonstrates the improved efficacy and stability of the inventive hydraulic fluids C to K and especially J (shows the synergistic action with isononanoylamidocaproic acid).

| | Hydraulic fluid | | | | | | | | | | | |
|---|---|---|---|---|---|---|---|---|---|---|---|---|
| Test criterion | A | B | C | D | E | F | G | H | I | J | K | L |
| Appearance (20° C.) | clear fluid | | | | | | | | | | | |
| pH (1% in water) | 9.5 | 9.5 | 9.5 | 9.5 | 9.5 | 9.5 | 9.5 | 9.5 | 9.5 | 9.5 | 9.5 | 9.5 |
| Hard water stability[1)] | turbid, sediment | clear | clear | clear | clear | clear | clear | clear | clear | clear | clear | clear |

TABLE 1-continued

Performance properties of fluids A-L
The table demonstrates the improved efficacy and stability of the inventive hydraulic fluids C to K and especially J (shows the synergistic action with isononanoylamidocaproic acid).

| | Hydraulic fluid | | | | | | | | | | | |
|---|---|---|---|---|---|---|---|---|---|---|---|---|
| Test criterion | A | B | C | D | E | F | G | H | I | J | K | L |
| Stability in seawater[2)] | turbid, sediment | clear | clear | clear | clear | clear | clear | clear | clear | clear | clear | clear |
| Foaming behavior | slight foaming | | | | | | no foam | | | | | |
| Lubrication test (Reichert)[3)] | | | | | | | | | | | | |
| wear scar ($mm^2$) | 20.9 | 29.7 | 12.2 | 18.3 | 20.2 | 14.5 | 12.5 | 15.5 | 13.1 | 17.6 | 19.5 | 22.5 |
| grinding distance (m) | 31 | 87 | 6 | 10 | 35 | 15 | 10 | 16 | 11 | 23 | 28 | 36 |
| Corrosion protection (DIN 51360/2)[4)] | 15% | 15% | 15% | 15% | 15% | 15% | 15% | 15% | 15% | 15% | 15% | 15% |

Explanations for table 1:
[1)]20% solution in water, 20° dH (corresponding to 350 ppm of $CaCO_3$), appearance after 24 h, 20° C.
[2)]50% solution in seawater, appearance after 24 h at 20° C.
[3)]Reichert friction wear balance, weight 1.5 kg, peripheral distance 100 m, peripheral speed 1.6 m/s; steel roll material
[4)]limiting concentration at which the filter paper still remains rust-free Examples 3 to 11 show the superior stability and lack of foam of the inventive hydraulic fluids compared to the prior art. Examples 3-12 demonstrate the improved lubricity and anticorrosive properties in the case of sole use of a dithiodi (arylcarboxylic acid), Example 12 shows how synergistic action with a further anticorrosive can achieve a reduced use concentration of the lubricant/anticorrosive active ingredient combination (4% compared to at least 7% in Examples 1 to 11), without losing efficacy. The synergistic action of the dithiodi(arylcarboxylic acids) with common water-soluble anticorrosives allows the use concentration of the additive package in the hydraulic fluid to be reduced, as shown by Example 12 compared to Examples 1 and 2 (known active ingredient combinations).

TABLE 2

Ecotoxicological data
Table 2 shows typical ecotoxicological data for corrosion and lubricant additives as required according to OSPAR for use in the North Sea. The OSPAR requirements are met only by dithiodi(benzoic acid).

| Example | Additive | Biodegradability (OECD 306) | Algal toxicity ($EC_{50}$) | Fish toxicity ($LC_{50}$) |
|---|---|---|---|---|
| OSPAR regulations | — | >20% or >60% | >10 mg/l | >10 mg/l |
| Comparison | Mercaptobenzothiazole | <20% | <1 mg/l | <10 mg/l |
| Comparison | N-Aminoethyloleyl-imidazoline | >60% | <1 mg/l | <10 mg/l |
| Additive from Example 3 | Dithiodi(benzoic acid) (as the salt) | >30% | >100 mg/l | >100 mg/l |

The invention claimed is:

1. A hydraulic fluid comprising a) water, b) at least one glycol, a polyglycol or both, and c) from 0.1 to 30% by weight of at least one compound of the formula 1

(1)

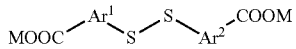

wherein

M is hydrogen, alkali metal, alkaline earth metal or ammonium, $Ar^1$ and $Ar^2$ are each independently mono- or polycyclic aromatic groups which may bear substituents or may contain heteroatoms, and wherein the $Ar^1$ and $Ar^2$ radicals each have only one substituent which is not H apart from the carboxyl group and the sulfide bridge.

2. The hydraulic fluid as claimed in claim 1, containing 35-70% by weight of water and 25-50% by weight of a glycol, of a polyglycol or both.

3. The hydraulic fluid as claimed in claim 1, wherein $Ar^1$ and $Ar^2$ are each groups of the formulae 2a-2c (2a)

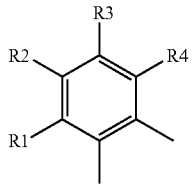

(2b)

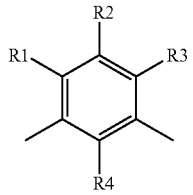

(2c)

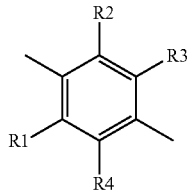

wherein $R^1$, $R^2$, $R^3$, $R^4$ are each independently H, $CH_3$, $C_2$-$C_{20}$-alkyl or -alkenyl, $C_3$- to $C_{20}$-cycloalkyl, halogen, $NO_2$, $NO_3$, CN, OX, $NH_2$, NHX or $N(X)_2$, where X=$C_1$-$C_{20}$-alkyl or $C_3$- to $C_{20}$-cycloalkyl.

4. A hydraulic fluid comprising a) water, b) at least one glycol, a polyglycol or both, and c) from 0.1 to 30% by weight of at least one compound of the formula 1

(1)

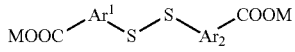

wherein

M is hydrogen, alkali metal, alkaline earth metal or ammonium, and wherein each of the $Ar^1$ and $Ar^2$ radicals are monocyclic aromatic radical of the formula 3

(3)

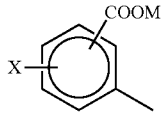

wherein the free valence indicates the position of the sulfide bridge, and X is a $C_1$- to $C_4$-alkyl group, a nitro group or a halogen atom.

5. The hydraulic fluid as claimed in claim 4, wherein X is in the para position to the sulfide bridge.

6. The hydraulic fluid as claimed in claim 4, wherein X is a methyl or ethyl group.

7. The hydraulic fluid as claimed in claim 1, wherein the formula 1 is dithiodibenzoic acid.

8. The hydraulic fluid as claimed in claim 1, further comprising at least one further anticorrosive selected from the group consisting of a) toluene- or benzenesulfonamidocaproic acids of the formula 6

(6)

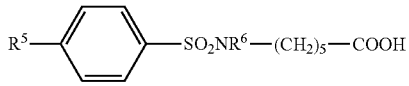

where $R^5$, $R^6$=H or $CH_3$, b) isononanoylamidocaproic acid of the formula 7

(7)

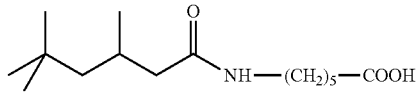

and c) triazinetrisaminohexanoic acid of the formula 8

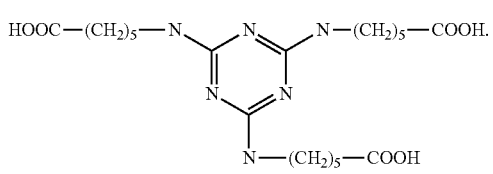

(8)

9. The hydraulic fluid as claimed in claim 1 further comprising at least one further anticorrosive selected from the group consisting of the aliphatic and aromatic carboxylic acids, the aliphatic and aromatic dicarboxylic acids, the aliphatic and aromatic polycarboxylic acids, the phthaiic monoamides, alkanesulfonamides and the alkanesulfonamidocarboxylic acids.

10. The hydraulic fluid as claimed in claim 1, further comprising a lubricant for reducing friction and abrasion.

11. The hydraulic fluid as claimed in claim 1, further comprising a neutralizing agent selected from the group consisting of the amines, alkanolamines, alkali metal hydroxides and oxides, and alkaline earth metal hydroxides and oxides.

12. The hydraulic fluid as claimed in claim 1, further comprising a freezing point depressant selected from the group consisting of the ethylene glycols, propylene glycols, alkyl glycols, and alkylpropylene glycols.

13. The hydraulic fluid as claimed in claim 1, further comprising a thickener selected from the group consisting of the polyacrylates, polymethacrylates, polyethylene glycols, polypropylene glycols, and polyalkylene glycols.

14. A process for improving the anti-corrosivity or lubricity of a hydraulic fluid, wherein the hydraulic fluid comprises water and at least one glycol, at least one polyglycol or mixtures thereof, comprising the step of adding from 0.1 to 30% by weight of a compound of the formula 1

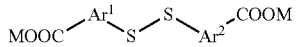

(1)

in which

M is hydrogen, alkali metal, alkaline earth metal or ammonium, $Ar^1$ and $Ar^2$ are each independently mono- or polycyclic aromatic groups which may bear substituents or may contain heteroatoms, and wherein the $Ar^1$ and $Ar^2$ radicals each bear only one substituent which is not H apart from the carboxyl group and the sulfide bridge to the hydraulic fluid.

15. The hydraulic fluid as claimed in claim 4, further comprising at least one further anticorrosive selected from the group consisting of a) toluene- or benzenesulfonamidocaproic acids of the formula 6

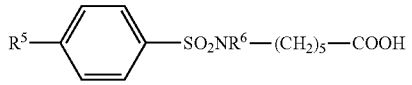

(6)

where $R^5$, $R^6$=H or $CH_3$, b) isononanoylamidocaproic acid of the formula 7

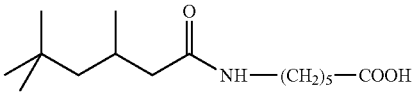

(7)

and c) triazinetrisaminohexanoic acid of the formula 8

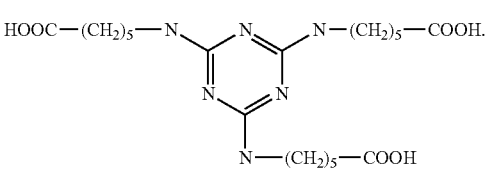

(8)

16. The hydraulic fluid as claimed in claim 4, further comprising at least one further anticorrosive selected from the group consisting of the aliphatic and aromatic carboxylic acids, the aliphatic and aromatic dicarboxylic acids, the aliphatic and aromatic polycarboxylic acids, the phthalic monoamides, alkanesulfonamides and the alkanesulfonamidocarboxylic acids.

17. The hydraulic fluid as claimed in claim 4, further comprising a lubricant for reducing friction and abrasion.

18. The hydraulic fluid as claimed in claim 4, further comprising a neutralizing agent selected from the group consisting of the amines, alkanolamines, alkali metal hydroxides and oxides, and alkaline earth metal hydroxides and oxides.

19. The hydraulic fluid as claimed in claim 4, further comprising a freezing point depressant selected from the group consisting of the ethylene glycols, propylene glycols, alkyl glycols, and alkylpropylene glycols.

20. The hydraulic fluid as claimed in claim 4, further comprising a thickener selected from the group consisting of the polyacrylates, polymethacrylates, polyethylene glycols, polypropylene glycols, and polyalkylene glycols.

21. A process for improving the anti-corrosivity or lubricity of a hydraulic fluid, wherein the hydraulic fluid comprises water and at least one glycol, at least one polyglycol or mixtures thereof, comprising the step of adding from 0.1 to 30% by weight of a compound of the formula 1

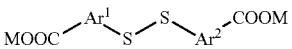

(1)

in which

M is hydrogen, alkali metal, alkaline earth metal or ammonium, and wherein each of the $Ar^1$ and $Ar^2$ radicals are a monocyclic aromatic radical of the formula 3
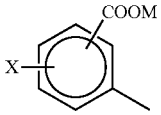
(3)
wherein the free valence indicates the position of the sulfide bridge, and X is a $C_1$- to $C_4$-alkyl group, a nitro group or a halogen atom to the hydraulic fluid.
* * * * *